US006345922B2

(12) United States Patent
Tani

(10) Patent No.: US 6,345,922 B2
(45) Date of Patent: Feb. 12, 2002

(54) CARTRIDGE TYPE FEEDING CONTAINER

(75) Inventor: Yoshikazu Tani, Tokyo (JP)

(73) Assignee: Tokiwa Corporation, Gifu (JP)

( * ) Notice: Subject to any disclaimer, the term of this patent is extended or adjusted under 35 U.S.C. 154(b) by 0 days.

(21) Appl. No.: 09/801,668

(22) Filed: Mar. 9, 2001

(30) Foreign Application Priority Data

Mar. 9, 2000 (JP) ..... 2000-065269

(51) Int. Cl.[7] ..... A45D 40/04; A45D 40/24

(52) U.S. Cl. ..... 401/32; 401/19; 401/29; 401/68; 401/75; 401/116

(58) Field of Search ..... 401/19, 20, 22, 401/32, 29, 68, 73–76, 92, 96, 97, 116, 117

(56) References Cited

U.S. PATENT DOCUMENTS 5,816,727 A * 10/1998 Ohba et al. ..... 401/68
5,888,004 A * 3/1999 Bouix ..... 401/75 X
6,155,734 A * 12/2000 Kageyama et al. ..... 401/75
6,200,047 B1 * 3/2001 Holloway ..... 401/75

* cited by examiner

*Primary Examiner*—Greogory L. Huson
*Assistant Examiner*—Kathleen J. Prunner
(74) *Attorney, Agent, or Firm*—Arent Fox Kintner Plotkin & Kahn, PLLC

(57) ABSTRACT

A cartridge type feeding container has a rod-like cosmetic material in which the rod-like cosmetic material is neither damaged nor pulled apart even if a buffering external shock is applied to the container and the cartridge is not pulled apart from the container body or any load is applied in a direction in which the core chucks and the feeding mechanism and dismounted apart from each other even if a torque is further applied to exceed a maximum fed condition. These advantages are the result of an internal member made of flexible material and provided on a part of an inner circumferential surface thereof with a cutaway formed by combining a slit cut in a circumferential direction. The internal member and the container body form a container cover portion such that a shock, applied from the outside of the container cover portion, is buffered in the cutaway in the internal member and is prevented from being transmitted to the cartridge.

5 Claims, 10 Drawing Sheets

CARTRIDGE TYPE FEEDING CONTAINER

FIELD OF THE INVENTION

The present invention relates to a cartridge type feeding container in which a rod-like cosmetic material such as an eye liner, an eye brow pencil, a lip liner, and an eye shadow is mounted in core chucks for holding the rod-like cosmetic material to form a cartridge, the core chucks are assembled into a cylindrical member that is called a front sleeve, and the cartridge is fed from a container body for detachably mounting the cartridge.

BACKGROUND ART

There is a cartridge type feeding container in which a rod-like cosmetic material such as an eye liner, an eye brow pencil, a lip liner, and an eye shadow is mounted in core chucks, the core chucks are assembled into a cylindrical member to form a cartridge, and the cartridge is assembled rotatable relative to a container body.

In such a cartridge type feeding container, a screw sleeve (feeding mechanism) within the container body that is in threaded relation with the core chucks is rotated relatively to move the core chucks in an axial direction to feed the rod-like cosmetic material.

By the way, in the conventional cartridge type feeding container, the core chucks (a moving member) and the container body (container cover portion) having the feeding mechanism containing the moving member for feeding the moving member are in direct engagement with each other. For this reason, in the case where an external shock is applied to the container body (container cover portion) such as when the cartridge type feeding container is dropped down, there is fear that the shock of the container cover portion is transmitted through the feeding mechanism to the core chucks (moving member) to cause the rod-like cosmetic material to be damaged or pulled part from the core chucks.

Also, in the conventional cartridge type feeding container, when a tip end portion of the core chucks is fed at a maximum in contact with a tip end portion of the front sleeve and is further relatively rotated to apply a torque to the feeding mechanism, there is fear that the core chucks are advanced to depress the cartridge to cause the cartridge to fall out from the container body or to dismount the core chucks and the feeding mechanism away from each other.

Accordingly, an object of the present invention is to provide a cartridge type feeding container in which a rod-like cosmetic material is neither damaged nor pulled apart even if a buffering external shock is applied to a cartridge type feeding container.

Also, another object of the present invention is to provide a cartridge type feeding container in which the cartridge is not pulled apart from the container body or any load is applied in a direction in which the core chucks and the feeding mechanism are dismounted apart from each other, even if a torque is further applied to exceed a maximum fed condition.

SUMMARY OF THE INVENTION

According to the present invention, a cartridge type feeding container comprising: a cartridge having a through hole and in which core chucks provided with a rod-like core material are inserted slidably in an axial direction in the through hole; a container body engaged with the cartridge to be mountable and relatively rotatable through an internal member; and a mechanism for feeding the core chucks to a tip end side of the cartridge or retracting the core chucks to a rear end side thereof by the relative rotation, is characterized in that the internal member is made of flexible material into a cylindrical shape, an outer circumferential surface fitting portion fitting with the container body is provided on a part of an outer circumferential surface of the internal member, a sleeve inner circumferential surface fitting portion fitting with the cartridge to be mountable and relatively rotatable is provided on a part of a sleeve inner circumferential surface thereof, a cutaway formed by combining a slit cut in a circumferential direction of the cylindrical circumferential surface is formed between the outer circumferential surface fitting portion and the inner circumferential surface fitting portion, the internal member and the container body form a container cover, and a shock to be applied from the outside of the container cover portion is buffered in the cutaway in the internal member and is prevented from being transmitted to the cartridge fitting with the inner circumferential surface fitting portion.

With such an arrangement, when the cartridge is installed in the container body through the internal member, the cartridge is assembled to be rotatable to the internal member but not pulled apart in the axial direction. Also, when the rear end side of the internal member is moved in the rotational direction and toward the opening side due to the buffering effect of the cutaway, the cartridge is moved synchronously. Assuming the case where the cartridge type feeding container falls down to a floor or the like, when the buffering external shock due to the drop is applied to the container cover portion, the dampening force to compress the cutaway to allow the axial and rotational movement and the flexibility of the internal member per se work to dampen the shock due to the drop and to prevent it from being transmitted to the cartridge side. Accordingly, since the shock is not transmitted to the core chucks, the rod-like core member inserted into the core chucks is not pulled apart or damage.

It is possible to exemplify the flexible internal member made of synthetic resin.

Also, according to the present invention, there is provided a cartridge type feeding container comprising: a cartridge having a through hole and in which core chucks provided with a rod-like core material are inserted slidably in an axial direction in the through hole; a cylindrical container body engaged with the cartridge to be detachable and relatively rotatable through an internal member; a longitudinal first rib provided in an axial direction on a sleeve inner circumferential surface of the container body and provided at a projecting end face with a slant surface; a screw sleeve having a screw portion having a substantially cylindrical shape that may be received in a sleeve of the container body and engaging with the core chucks in the substantially cylindrical inner circumferential surface, the screw sleeve engaging with the cartridge to be rotatable relative thereto; a second longitudinal rib projecting in an axial direction on a substantially cylindrical outer circumferential surface of the screw sleeve and engaging with the first longitudinal rib to be movable in the axial direction; and an internal member made of flexible material into a cylindrical shape and in which an outer circumferential surface fitting portion fitting with the container body is provided on a part of the sleeve outer circumferential surface, an inner circumferential surface fitting portion fitting with the cartridge to be mountable and relatively rotatable is provided on a part of the sleeve inner circumferential surface, and a cutaway formed by combining a slit cut in a circumferential direction is formed between the outer circumferential surface fitting portion and the inner circumferential surface fitting portion; wherein the first longitudinal rib and the second longitudinal rib engage with each other upon the relative rotation so that the container body and the screw sleeve are rotated together to feed the core chucks, threadedly engaging with the screw sleeve, to a tip end side of the cartridge of to retract the core chucks to a rear end side and an engagement portion for engaging the core chucks is provided in a through hole of the cartridge, when the core chucks are fed and brought into contact with the engagement portion of the cartridge and the core chucks are further fed, the cartridge depresses the inner circumferential fitting portion of the internal member toward the tip end side to compress the cutaway portion so that the screw sleeve kept in threaded engagement with the core chucks is moved toward the tip end side corresponding to the compression of the cutaway, whereby the engagement condition between the first longitudinal rib and the second longitudinal rib is released in a slant surface position of the first longitudinal rib.

With such an arrangement, when the core chuck is fed at maximum with a further relative rotation in the feeding direction, the tip end of the core chucks is brought into the engagement portion at the tip end of the cartridge and the core chucks no longer move. However, when the further relative rotation is kept on, the cartridge is depressed by means of the core chucks to tend to move forwardly and to compress the cutaway of the internal member having the flexibility through the engagement portion. Then, the cartridge including the screw sleeve is moved forwardly corresponding to the compression of the cutaway, and at the same time, the slant surface of each first longitudinal rib works to push the end face of the second longitudinal rib to release the engagement condition between the second longitudinal rib and the first longitudinal rib so that the rotation of the container body is not transmitted to the screw sleeve. Accordingly, the slant surface provided in the first longitudinal rib serves a torque limiter. There is no fear that the cartridge would be pulled apart from the container body or the front sleeve, the core chucks, and the screw sleeve are dismounted from each other within the cartridge.

Incidentally, under the condition that the engagement condition between the longitudinal ribs is released, if the relative rotation is interrupted, the elastic force due to the interruption of the compression of the cutaway is generated on the rear end side of the internal member so that the cartridge is moved toward the rear end. Then, the second longitudinal rib of the screw sleeve and the first longitudinal rib of the cartridge are returned back to the engagement condition.

Furthermore, the cartridge type feeding container for example, the slant surface is provided at a projecting end face of the second longitudinal rib. With such an example, since the second longitudinal rib facing the slant surface of the first longitudinal rib side is a slanted surface, it is possible to smoothly perform the release of engagement between the longitudinal ribs.

BEST MODE FOR EMBODYING THE INVENTION

A preferred embodiment of the present invention will now be described with reference to the drawings.

[Embodiment 1]

According to this Embodiment 1, a cartridge type feeding container will be described in which a rod-like cosmetic material (for example, an eye liner) M is received in a cartridge as a rod-like core member and the relative rotation between the cartridge and a container body feeds the rod-like cosmetic material M.

Figure 1:
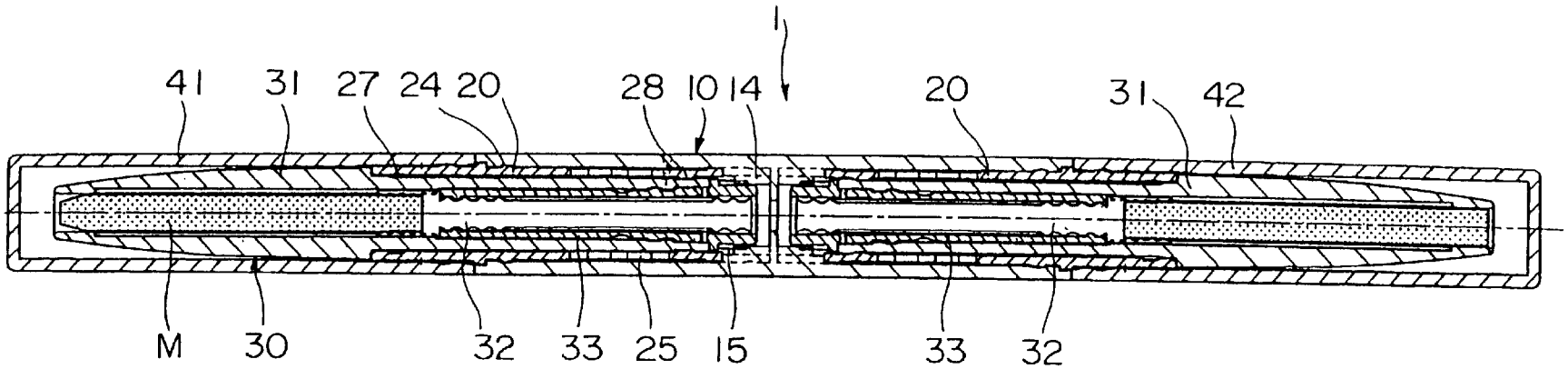
FIG. 1 is a longitudinal sectional view of a cartridge type feeding container in accordance with one embodiment of the invention.

As shown in FIG. 1, the overall shape of the cartridge type feeding container 1 is an elongated rod-shape like a writing instrument. The cartridge type feeding container 1 is provided with a container body 10, internal members 20 each inserted partially into the container body 10 and fitted with the container body 10, a cartridge 30 assembled into the internal member 20 and the container body 10 and engaged therewith rotatably, and caps 41 and 42 for covering this cartridge 30. Incidentally, the container body 10, the internal member 20 and the caps 41 and 42 constitute a container cover portion for covering the cartridge 30.

Figure 2:
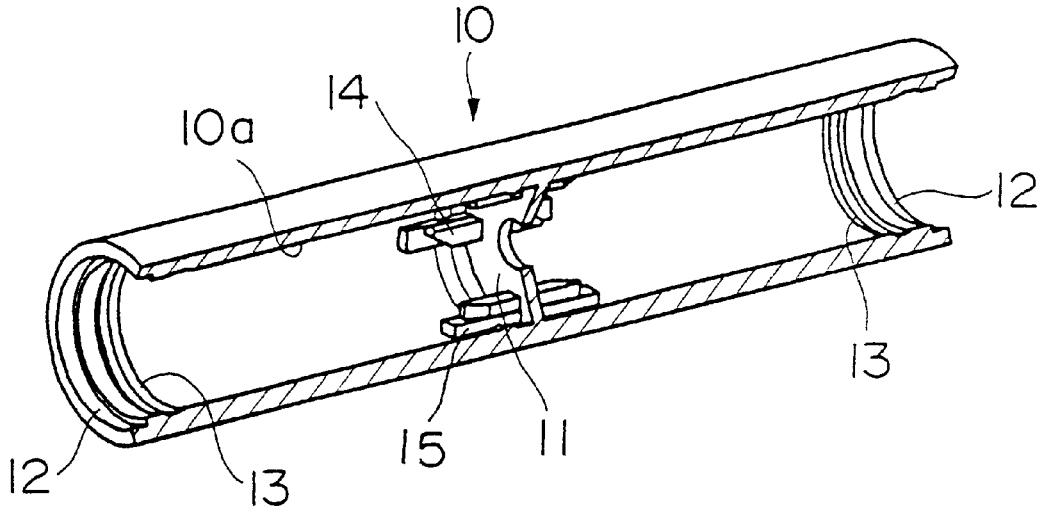
FIG. 2 is a perspective view of a part of the container body.
Figure 3:
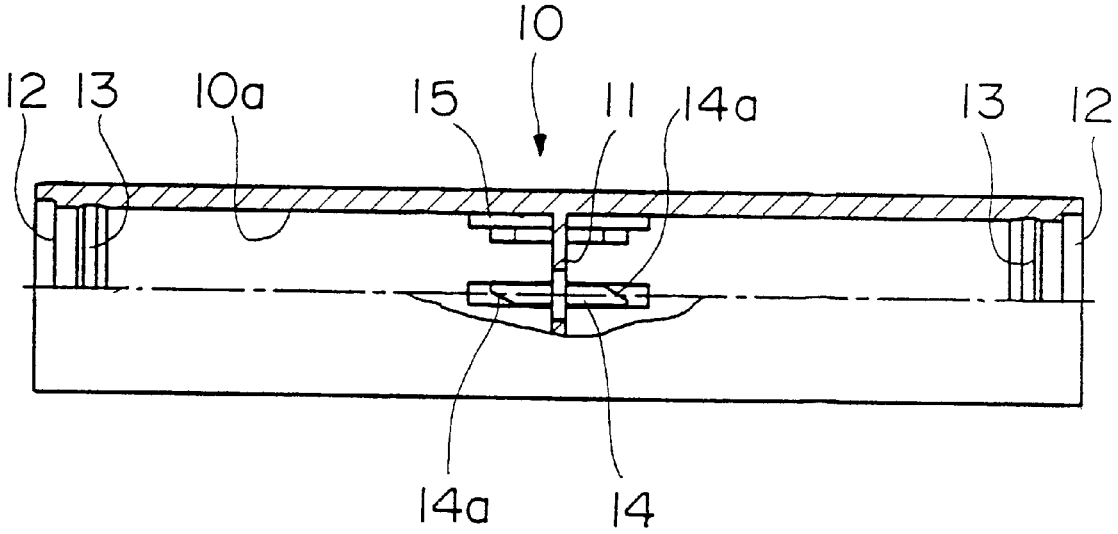
FIG. 3 is a side elevational view of a section taken along a part of the container body.

As shown in FIGS. 1 to 3, the container body 10 is in the form of a hollow cylindrical shape for receiving therein a part of the cartridge 30 through the internal member 20, i.e., a part of a front sleeve 31, and a screw sleeve 33 as a whole.

A sleeve interior portion 10*a* of the container body 10 is partitioned at an intermediate position by an internal partition 11. The container body 10 is formed into a shape having the same function in the right and left portions with respect to the internal partition 11. More specifically, a stepped opening 12 that is greater than an internal diameter of the sleeve interior portion 10*a* is formed on the opening side of the container body 10 and an annular groove portion 13 is formed on an inner circumferential surface apart at a predetermined distance (dimension L to be described later) from this stepped opening 12.

Also, four longitudinal ribs (first longitudinal ribs) 14 and four contact portions 15 are formed toward the opening side in the internal partition 11. The four longitudinal ribs 14 are arranged at an equal interval on the opening side from the internal partition 11. Incidentally, a slant surface 14*a* having an angle of 60° is formed in a projecting end face toward the opening side of each longitudinal rib 14. This longitudinal rib 14 is engaged with a longitudinal rib (second rib) 33*g* of the screw sleeve 33 to be described later. Also, the four contact portions 15 are arranged at an equal interval on the opening side from the internal partition 11. Each contact portion 15 is brought into contact with a stepped portion 26 of the internal member 20 to be described later.

Figure 4:
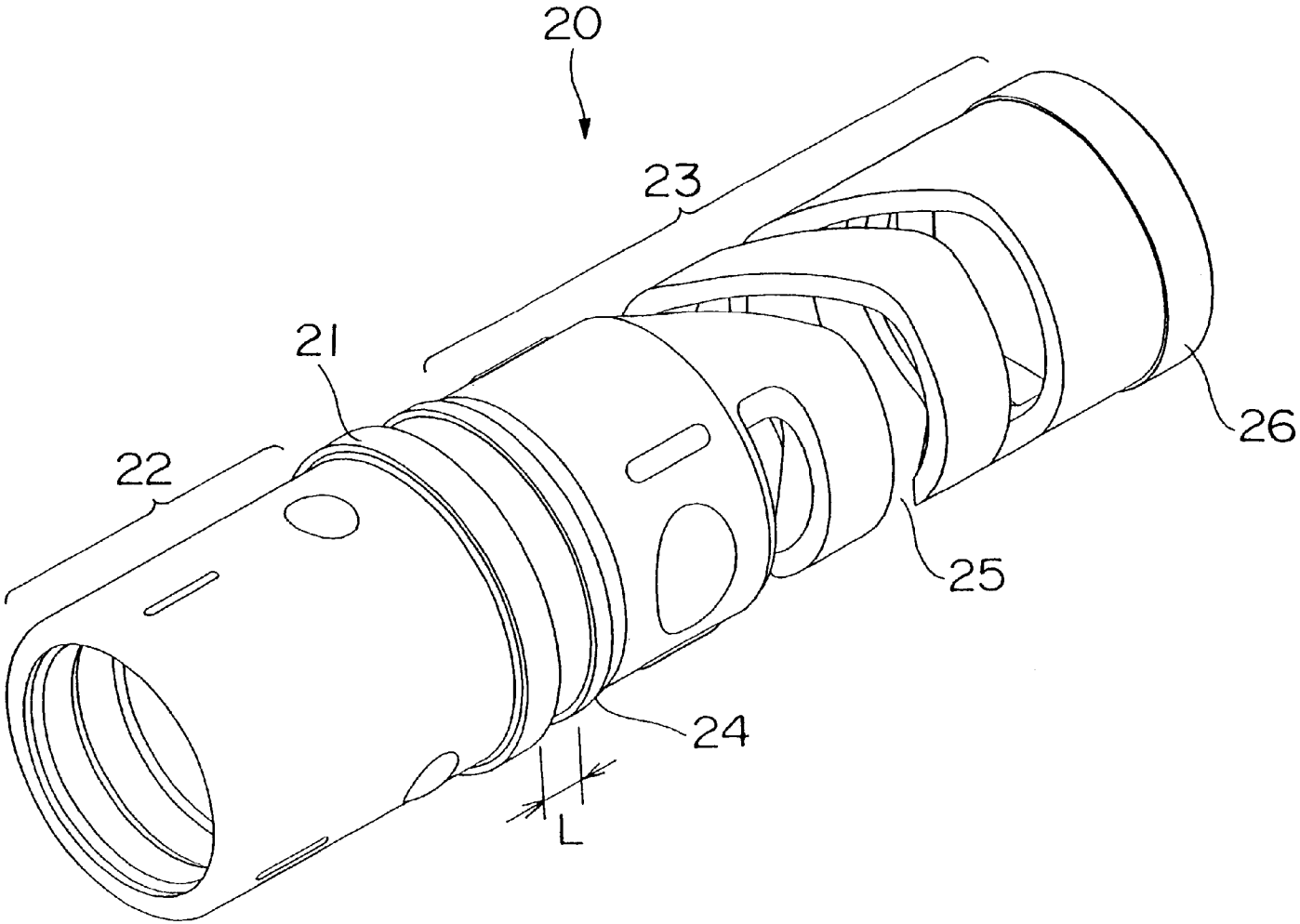
FIG. 4 is an enlarged perspective view of an internal member.

Each internal member 20 is made of synthetic resin. As shown in FIG. 4, the internal member is substantially cylindrical with an annular flange portion 21 being formed along the outer circumferential surface at a position close to a tip end by about one third of the overall length. This annular flange portion 21 engages with the stepped opening 12 of the container body 10. Also, an outer circumferential surface of the tip end side 22 with which the caps 41 and 42 are engaged detachably is formed from the annular flange portion 21. An outer circumferential surface of the rear end side 23 is formed to be insertable into the container body 10.

An annular projection (outer circumferential surface fitting portion) 24 is formed on the outer circumferential surface apart at the distance L on the rear end side 23 from the annular flange portion 21. Also, an annular stepped portion 26 is formed at an end portion of the rear end side 23. Then, when the projection 24 is inserted into a groove portion 13, the portion in the vicinity of the annular flange portion 21 is fixed to be unmovable in the axial direction with this engagement relation. On the other hand, the stepped portion 26 is brought into contact with contact portions 15 and the internal member 20 is fixed to the container body 10.

The outer circumferential surface of the rear end side 23 is formed to be raised by one step at the portion in the vicinity of the annular flange portion 21 and the stepped portion 26 and the outer circumferential surface is formed to be lowered between the portion in the vicinity of the annular flange portion 21 and the stepped portion 26. A cutaway 25 formed by cutting to form a spiral slit is formed in the outer circumferential surface between the annular projection 24 and the annular stepped portion 26. Then, the rear end side 23 of the internal member 20 is extendable or contractible to have a buffering effect with the cutaway 25. Accordingly, in the case where the cutaway 25 is compressed the stepped portion 26 is movable toward the opening side.

An annular groove portion 27 (see FIG. 1) is formed in a recess shaped in the inner circumferential surface of the front end side 22 and an annular convex portion (inner circumferential surface fitting portion) 28 is formed to project inwardly on the rear end side 23 on the inner circumferential surface of the portion in the vicinity of the end portion of the rear end side 23. The annular convex portion 28 is engaged with a circumferential groove portion 31*c* of the front sleeve 31 to be described later.

Figure 5:
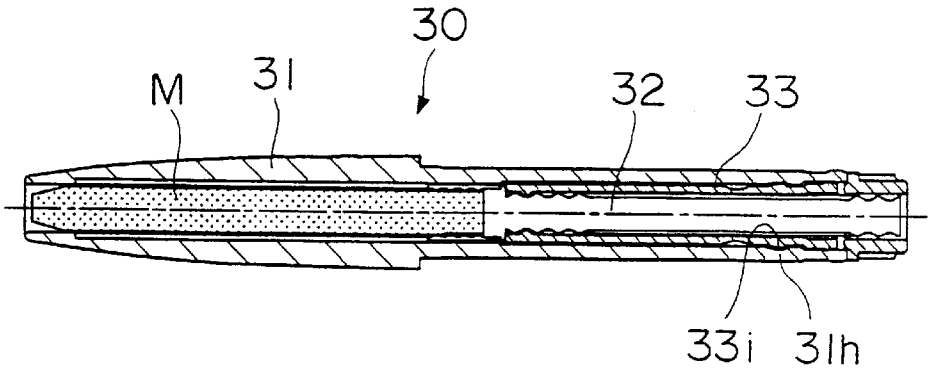
FIG. 5 is a longitudinal sectional view of a cartridge.

As shown in FIG. 5, the cartridge 30 is provided with the front sleeve 31 for receiving the rod-like cosmetic material M, core chucks 32 for gripping the rod-like cosmetic material M, and a screw sleeve 33 kept in threaded relation with the core chucks 32.

Figure 6:
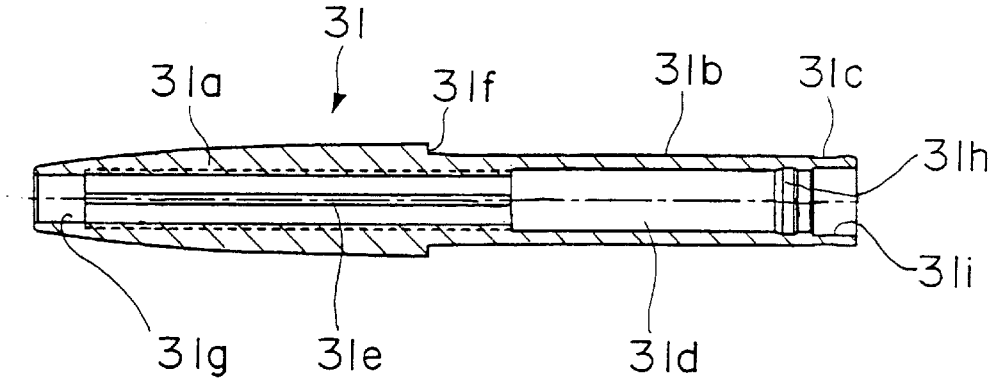
FIG. 6 is a longitudinal sectional view of a front sleeve.

As shown in FIGS. 5 and 6, the front sleeve 31 is formed of a large diameter portion 31*a* and a small diameter portion 31*b* continuous with a rear end of the large diameter portion 31*a*. A large diameter portion 31*a* has a circular shape in cross section and a tapered shape to become gradually thinner toward the tip end. On the other hand, a circumferential groove portion 31*c* extending in the circumferential direction is formed on the outer circumferential surface from the rear end of the small diameter portion 31*b*. The outer diameter of the small diameter portion 31*b* is smaller than the inner diameter of the internal member 20 and formed to be insertable. Then, when the cartridge 30 is mounted on the internal member 20, the tip end of the internal member 20 is brought into contact with a stepped portion 31*f* of the front sleeve 31, and the annular convex portion 28 on the internal member 20 side is engaged with the circumferential groove portion 31*c* of the small diameter portion 31*b* so that the front sleeve 31 (cartridge 30) is assembled into the internal member 20 to be rotatable but unmovable in the axial direction. Also, when the rear end side 23 of the internal member 20 is moved toward the opening side, the front sleeve 31 is moved synchronously therewith by the buffering effect of the cutaway 25.

Figure 7:
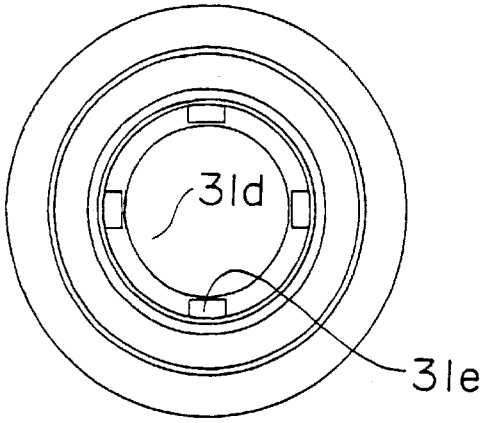
FIG. 7 is a frontal view of the front sleeve.

Also, a small diameter hole 31*g* through which only the rod-like cosmetic material M may pass is formed in the longitudinal direction of the front sleeve 31, and a through-hole 31*d* is formed for receiving the core chucks 32 and the screw sleeve 33. Elongated projections 31*e* (see FIG. 7) projecting in a cruciform are formed in the longitudinal direction (axial direction) from a constant distance from the tip end side of the through-hole 31*d* except for a constant distance from the rear end side. The core chucks 32 that have moved to the tip end side are retained by means of the stepped portions (engagement portions) of the small diameter hole 31*g* and the large diameter portion 31*a*. Also, an annular recess portion 31*h* for engaging the screw sleeve 33 inserted into the through hole 31*d* to be unmovable in the axial direction is formed at the rear end side of the through hole 31*d*. Furthermore, a stepped portion 31*i* having a diameter greater than a diameter of the through hole 31*d* is formed at the rear end of the through hole 31*d*.

Figure 8:
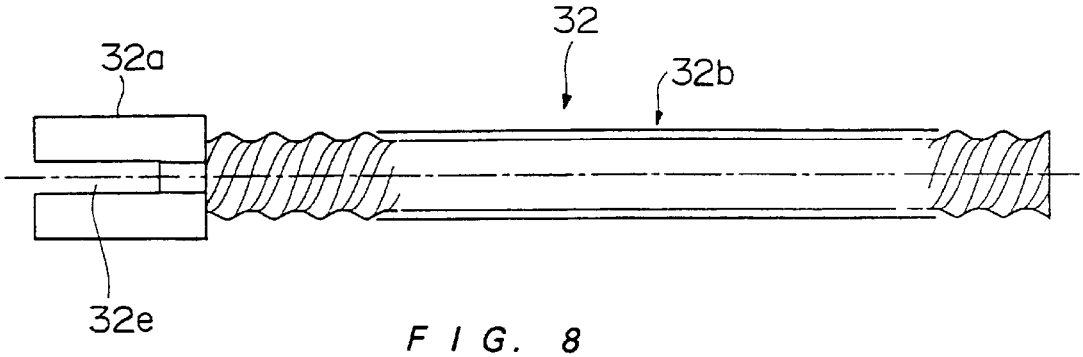
FIG. 8 is a side elevational view of core chucks.
Figure 9:
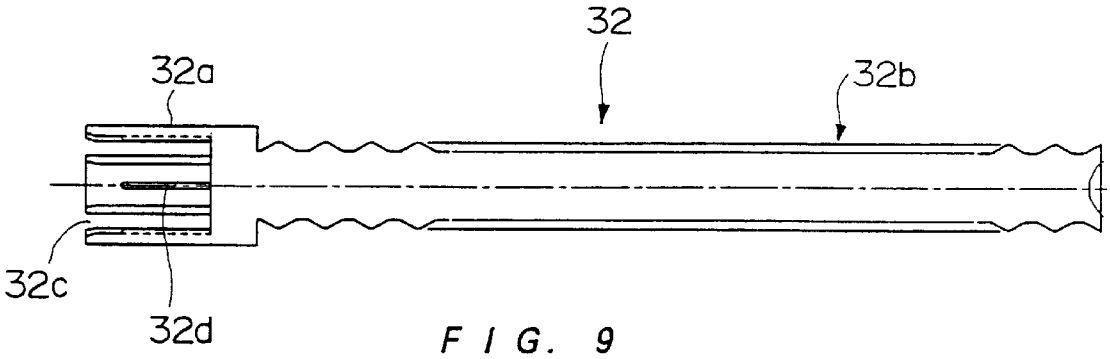
FIG. 9 is a side elevational sectional view of the core chucks.

As shown in FIGS. 8 and 9, the core chucks 32 are formed of grip portions 32*a* for gripping the rod-like cosmetic material M and a screw shaft 32*b* continuous with a rear end of the grip portions 32*a*.

Figure 10:
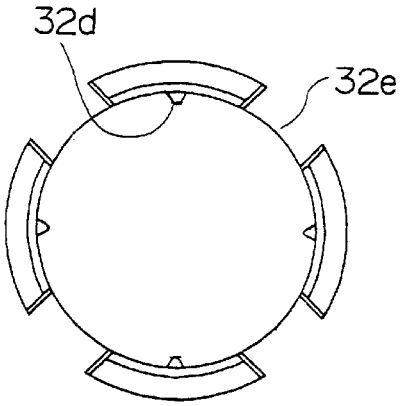
FIG. 10 is a frontal view of the core chucks.
Figure 11:
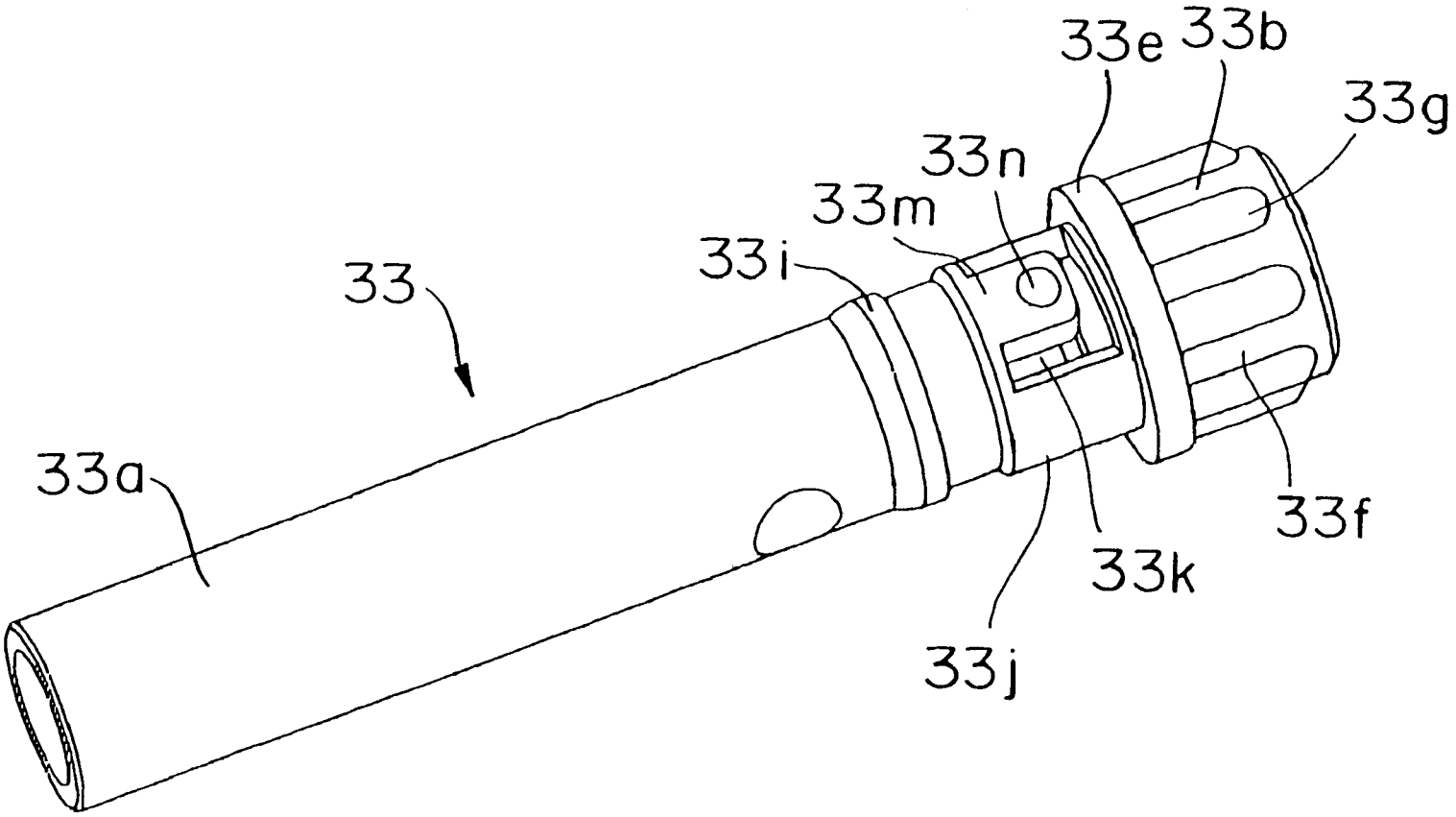
FIG. 11 is a perspective view showing an outer circumferential portion of a screw sleeve.

The grip portions 32*a* form a substantially cylindrical shape that may be inserted into the through hole 31*d* of the front sleeve 31. Also, an insertion hole 32*c* into which the rod-like cosmetic material M is to be inserted is formed in the tip end side of the grip portions 32*a*. As shown in FIG. 10, four elongated projections 32*d* are formed in the axial direction within this insertion hole 32*c*. The four elongated projections 32*d* prevent the rod-like cosmetic material M from moving in the rotating direction and grip the rod-like cosmetic material M. Furthermore, four cutaways 32*e* (see FIG. 10) are formed in a cruciform in the axial direction corresponding to the cruciform directions of the elongated projections 31*e* (see FIG. 7) formed on the inner surface of the front sleeve 31 are formed on the outer circumferential surface of the grip portions 32*a*. A width dimension of the cutaways 32*e* is somewhat larger than the width dimension of the elongated projections 31*e*. When the core chucks 32 are to be received in the through hole 31*d* of the front sleeve 31, the elongated projections 31*e* of the front sleeve 31 are engaged with the cutaway 32*e* so that the core chucks 32 are received to be unrotatable but movable in the axial direction within the through-hole 31*d*. Accordingly, it should be noted that the elongated projections 31*e* of the front sleeve 31 are guide pieces for guiding the core chucks 32 along the through hole 31*d,* and the cutaways 32*e* of the core chuck 32 are guide grooves.

A screw groove threadedly engaging with the screw sleeve 33 is formed in the screw shaft 32*b*.

The screw sleeve 33 is made of synthetic resin. As shown in FIGS. 11 to 15, a cylindrical shaft portion 33*a* and a cylindrical gear portion 33*b* continuous with the cylindrical shaft portion 33*a* are formed in the screw sleeve 33. A through hole 33*c* passes through the cylindrical shaft portion 33*a* and the gear portion 33*b*.

Figure 12:
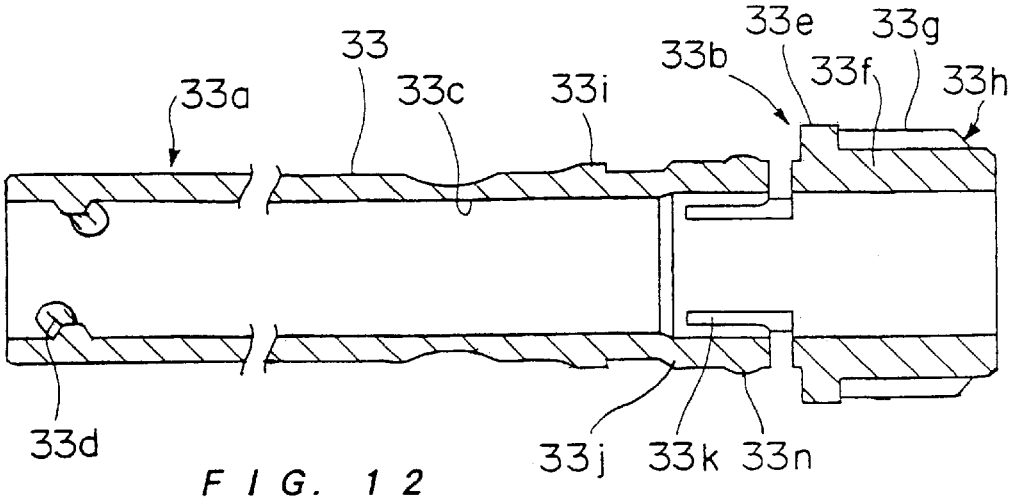
FIG. 12 is a side elevational longitudinal view of the screw sleeve.
Figure 13:
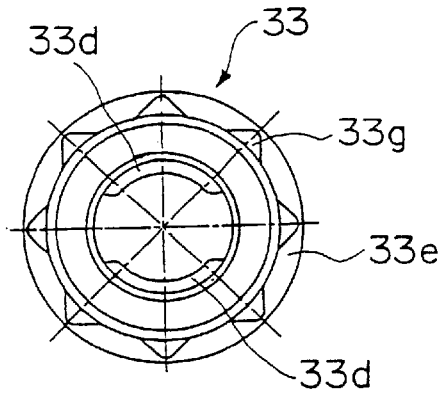
FIG. 13 is a perspective view of a rear portion of the screw sleeve.

As shown in FIG. 12, two projections 33*d* are formed on the inner circumferential surface of the through hole 33*c*. The projections 33*d* are threadedly engaged with the screw groove of the screw shaft 32*b* so that the rotation of the screw sleeve 33 is transmitted to the core chucks 32.

The gear portion 33*b* has a stepped cylindrical shape having a flange portion 33*e*. Longitudinal ribs (second longitudinal ribs) 33*g* are formed in the axial direction on the outer circumferential surface of the small diameter portion 33*f*. The eight longitudinal ribs 33*g* are formed at an equal interval in the circumferential direction (see FIG. 13). a slant surface 33*h* (see FIG. 12) is formed at an angle of 45 degrees in the projected end surface of each longitudinal rib 33*g*.

Also, an annular convex portion 33*i* projecting along the circumference is formed on the outer circumferential surface, on the gear portion 33*b* side of the cylindrical shaft portion 33*a,* and at the same time, an annular stepped portion 33*j* that is somewhat larger than the outer diameter of the cylindrical shaft portion 33*a* is formed at a constant distance in the portion connected with the gear portion 33*b*. Incidentally, a length of the annular stepped portion 33*j* in the axial direction is smaller than a length of the stepped hole 31*i* of the front sleeve 31, and a shaft diameter of the annular stepped portion 33*j* is formed smaller than a diameter of the stepped hole 31*i*.

Two U-shaped divided grooves 33*k* (see FIG. 11) are formed in the outer circumferential surface of the annular stepped portion 33*j*. The U-shaped divided grooves 33*k* are formed at two positions diametrically opposite each other. Engagement projections 33*n* and 33*n* projecting from the outer wall are formed at two positions in peninsula portions formed by cutting the U-shaped divided grooves 33*k* in the outer circumferential surface of the annular stepped portion 33*j*. A dimension between apexes of the projecting engagement projections 33*n* and 33*n* is formed to be somewhat larger than a diameter of the stepped hole 31*i* of the front sleeve 31. Incidentally, the peninsula portions 33*m* and 33*m* serve as leaf springs due to the flexibility of the material of synthetic resin.

Figure 15:
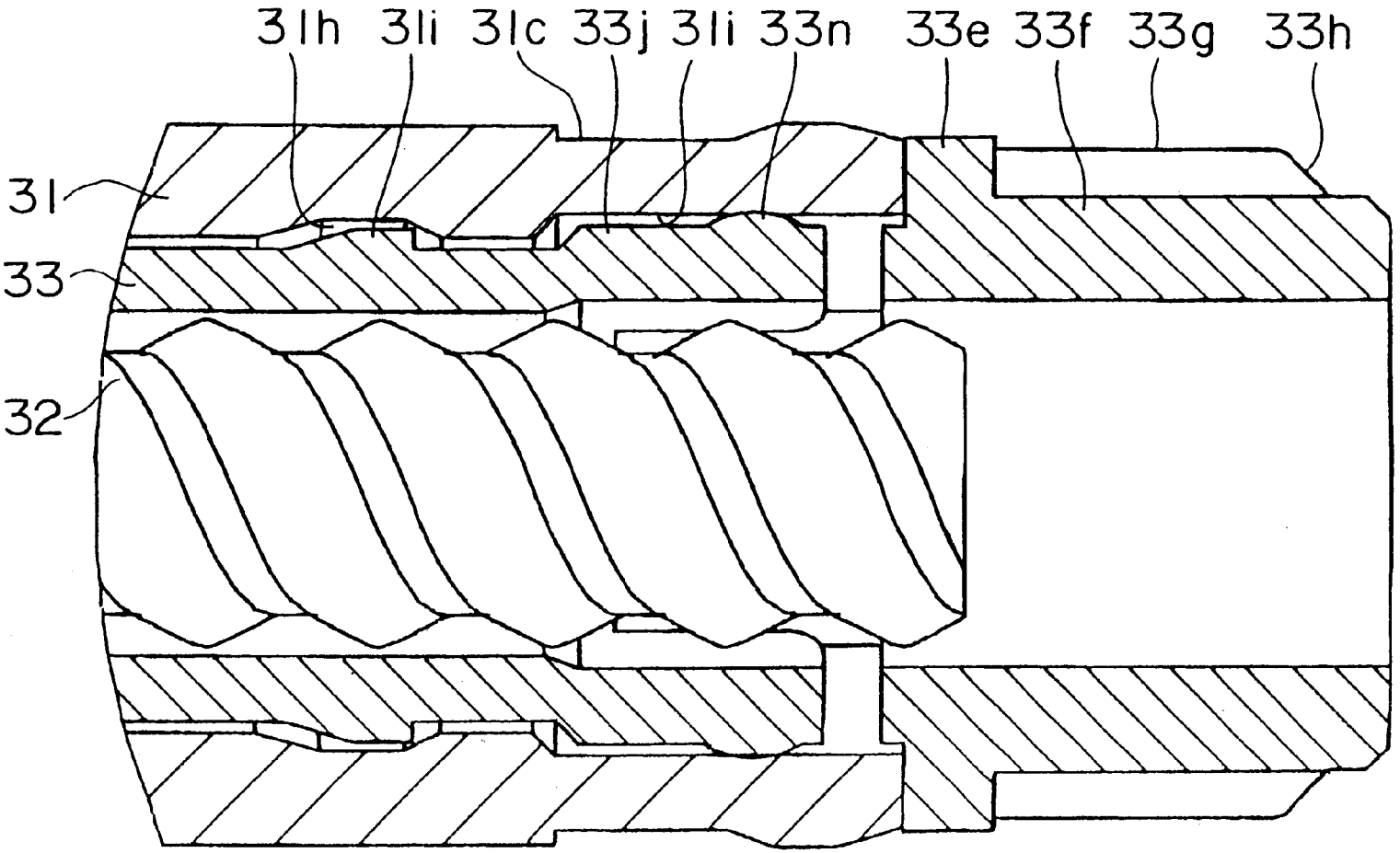
FIG. 15 is an enlarged longitudinal view of a rear portion of the cartridge.

Then, when the cylindrical shaft portion 33*a* is inserted into the through hole 31*d* and the stepped hole 31*i* of the front sleeve 31 so that the rear end portion of the front sleeve 31 and the flange portion 33*e* are brought into contact with each other, as shown in FIG. 15, the annular convex portion 33*i* is inserted into the annular recess portion 31*h* and the screw sleeve 33 is engaged with the front sleeve 31 to be unmovable in the axial direction. Also, the engagement projections 33*n* and 33*n* are engaged with the inner circumferential surface of the stepped hole 31*i* to generate the rotational resistance due to the spring force of the leaf springs (peninsula portions 33*m* and 33*m*) in the engagement portions.

Figure 14:
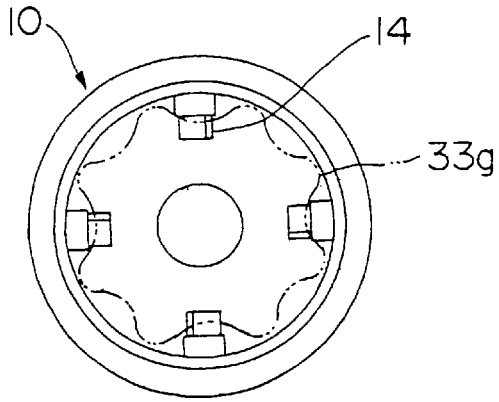
FIG. 14 is a frontal view of the container body.

Then, when the cartridge 30 is mounted on the container body 10, the longitudinal ribs 33*g* and the longitudinal ribs 14 are engaged with each other (see FIG. 14). Then, when the cartridge 30 and the container body 10 are rotated relative to each other, the screw sleeve 33 is rotated together with the container body 10 against the rotational resistance with the front sleeve 31. Also, regarding movement in the axial direction, when the screw sleeve 33 is moved through a predetermined distance toward the opening side relative to the container body 10, the slant surfaces 33*h* of the longitudinal ribs 33*g* and the slant surfaces 14*a* of the longitudinal ribs 14 face each other to thereby release the engaged condition.

The caps 41 and 42 are formed into bottomed cylindrical shapes as shown in FIG. 1. Then, when each of the caps 41 and 42 receives the rod-like cosmetic material M, the front sleeve 31 and the tip end portion 22 of the internal member 20 are inserted into the annular flange portion 21, thereby covering the front sleeve 31. The caps 41, 42 are formed so as to be readily detachable due to a frictional effect with the outer circumferential surface of the tip end portion 22 of the internal member 20.

The operation of the cartridge type feeding container 1 will now be described.

In the cartridge type feeding container 1, when the cartridge 30 is mounted on the container body 10 through the internal member 20, the tip end of the internal member 20 is brought into contact with the stepped portion 31*f,* the annular convex portion 28 on the internal member 20 side is engaged with the circumferential groove portion 31*c* of the small diameter portion 31*b,* and the cartridge 30 is assembled into the internal member 20 to be rotatable but unmovable in the axial direction. Also, the cartridge 30 (front sleeve 31) is movable synchronously when the rear end side 23 of the internal member 20 is moved to an opening side and to the rotational direction due to the buffering effect of the cutaway 25.

Therefore, assuming the case where the cartridge type feeding container 1 (under the condition shown in FIG. 1) on which the caps 41 and 42 are mounted is dropped down to a floor or the like, when the external buffering force due to the drop is applied to the container cover portions (the container body 10 and the caps 41 and 42), the flexibility of the internal member 20 made of synthetic resin and the buffering property for compressing the cutaway 25 and moving it in the axial direction and the rotational direction work, to thereby easing the shock caused by the drop to avoid the transmission thereof to the cartridge 30 side (the front sleeve 31, the core chucks 32 and the screw sleeve 33). Accordingly, the shock is not transmitted to the core chucks 32, so that the rod-like cosmetic material M inserted into the core chucks 32 is not pulled apart or damaged.

Figure 16:
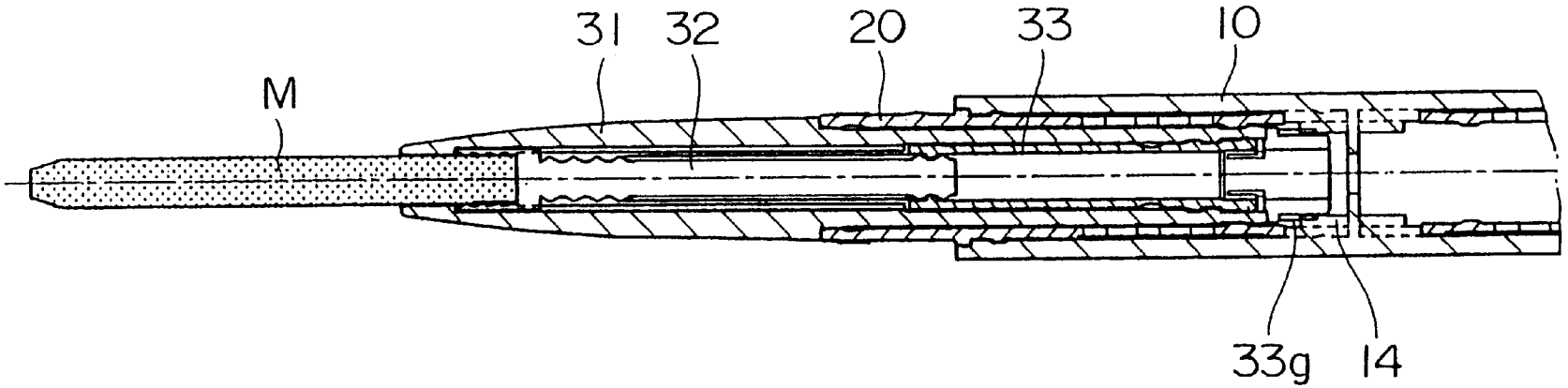
FIG. 16 is an illustration of a case where a rod-like cosmetic material is fed in the cartridge type feeding container.

Subsequently, under the condition that the cartridge 30 is fitted with the container body 10, when these components are rotated relative to each other, as shown in FIG. 16, the longitudinal ribs 14 included in the container body 10 and the longitudinal ribs 33*g* provided on the outer circumference of the rear portion of the screw sleeve 33 within the cartridge 30 are engaged with each other so that the screw sleeve 33 is rotated together with the container body 10 against the rotational resistance with the front sleeve 31.

When the screw sleeve 33 is rotated, since the core chucks 32 in threaded relation with the inside of the screw sleeve 33 is engaged with the core chucks 32 to be unrotatable but movable in the axial direction so that the core chucks 32 moved back and forth within the front sleeve 31. Then, the rod-like cosmetic material M is fed from the through hole 31*d* of the front sleeve 31 or retracted. Incidentally, when the relative rotation between the container body 10 and the cartridge 30 is stopped, since the rotational resistance due to the spring force of the leaf springs (peninsula portions 33*m* and 33*m*) in the engagement portion between the inner circumferential surface of the stepped hole 31*i* of the front sleeve 31 and the engagement projections 33*n* and 33*n* of the screw sleeve 33 is generated, the front sleeve 31 and the screw sleeve 33 are in engagement with each other. Accordingly, even if the external force is applied through the rod-like cosmetic material M to the core chucks 32, the core chucks 32 are not moved back and forth as far as the rotational resistance exceeds the external force.

Then, when the core chucks 32 are fed at a maximum with the further relative rotation in the feeding direction, the tip end of the core chucks 32 is brought into contact with the stepped portions of the small diameter hole 31*g* and the through hole 31*d* of the front sleeve 31, the core chucks 32 no longer move. However, if the further relative rotation is kept, the front sleeve 31 is depressed by the core chucks 32 to tend to move forwardly so that the cutaway 25 is compressed through the circumferential groove portion 31*c* and the annular convex portion 28 which are in engaged relation with each other. Then, the cartridge 30 is moved forward together with the screw sleeve 33 corresponding to the compressed portion of the cutaway 30, and at the same time, the slant surface 14*a* of each longitudinal rib 14 pushes forward the slant surface 33*h* of the associated longitudinal rib 33*g*, the engagement condition between the longitudinal ribs 14 and 33*g* is released so that the rotation of the container body 10 is not transmitted to the screw sleeve 33. Accordingly, the cartridge 10 is not pulled apart from the container body 10, and the front sleeve 31, the core chucks 32 and the screw sleeves 33 are not dismounted from each other within the cartridge 30. Thus, in the present embodiment, the slant surface formed in each longitudinal rib serves as a torque limiter.

Incidentally, under the condition that the engagement condition between the longitudinal ribs 33*g* and 14 is released, if the relative rotation is stopped, the elastic force due to the stop of the compression of the cutaway 25 is generated at the rear end side 23 of the internal member 20 so that the cartridge 30 (front sleeve 31) is moved to the rear end side. Then, the longitudinal ribs 33*g* of the screw sleeve 33 and the longitudinal ribs 14 of the container body 10 are returned back to the engagement condition.

[Embodiment 2]

Figure 17:
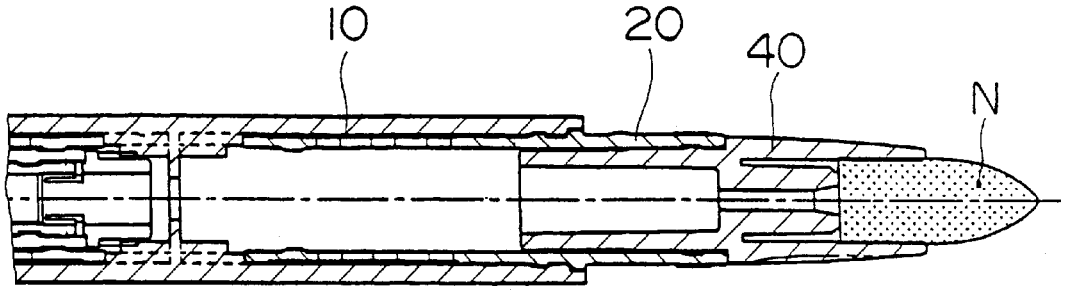
FIG. 17 is a longitudinal sectional view of a cartridge type feeding container in accordance with another embodiment of this invention.
Figure 18:
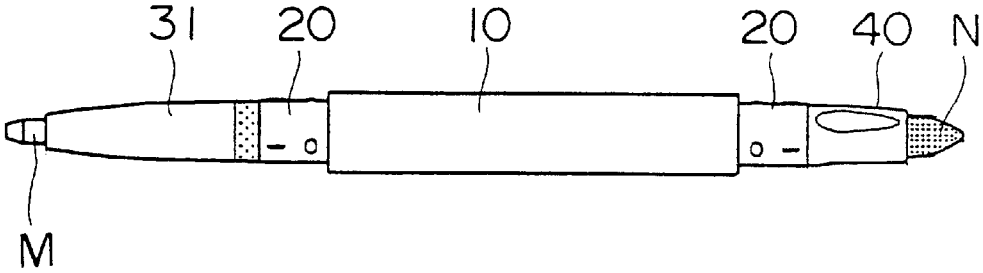
FIG. 18 is an overall view of the cartridge type feeding container in accordance with further another embodiment of the invention.

In the above-described Embodiment 1, two cartridges 30 are installed on both sides of the sleeve interior 10*a* of the container body 10. However, as Embodiment 2, a cosmetic coating tool (chip made of sponge) N may be installed on one side of the sleeve interior 10*a*. Namely, as shown in FIGS. 17 and 18, the cosmetic coating tool N clamped by a retainer member (tail plug) 40 instead of the cartridge 30 is inserted into the container body 10 in which the internal member 20 is fitted. Incidentally, the difference between Embodiment 1 and Embodiment 2 is only that the retainer member 40 and the cosmetic coating tool N are installed instead of the cartridge 30 to be installed in the internal member. The other parts are the same as those of Embodiment 1 and the explanation therefor will be omitted.

As shown in this Embodiment 2, it is possible to install not only the cartridge but also the cosmetic tool such as a coating tool in the inner circumferential surface of the internal member of the cartridge type feeding container of this invention. The container is abundant in versatility.

Incidentally, in the above-described Embodiment 1, the arrangement in which the slant surfaces are formed in the projecting end faces of both of the longitudinal ribs is taken and explained. However, it is apparent that the invention is not limited to the arrangement in which the slant surfaces are formed on both of the longitudinal ribs. Namely, if the slant surface is formed at least on the projecting end face of the first longitudinal rib side, the forward movement of the second longitudinal rib due to the spring force of the cutaway of the internal member is further pushed out by the slant surface, so that the engagement condition of the longitudinal ribs with each other may be smoothly released.

Also, in the above-described Embodiment 1, since the tip end portion of the core chucks 32 is engaged with the engagement portion of the through hole, the structure is taken in which the engagement portion is provided at the tip end side of the through hole. However, it is sufficient that the core chucks may be retained by the engagement portion when the core chucks moves to the tip end side of the through hole and the position of the engagement portion is not limited to the tip end side of the through hole.

Furthermore, the rod-like core member is not limited to a rod-like cosmetic material and it is possible to use a rod-like pigment.

According to the present invention, the shock applied to the container cover portion is buffered by the cutaway provided in the internal member in addition to the flexibility of the internal member per se and is prevented from being transmitted to the core chucks and the rod-like core material.

Also, according to the present invention, even if the torque is further applied exceeding the maximum feeding level, the engagement condition between the second longitudinal ribs and the first longitudinal ribs is released by the slant surfaces provided in the first longitudinal ribs and the elastic force of the cutaway of the internal member, and the cartridge type feeding container may be used for a long period of time without the cartridge pulled apart from the container body, or the front sleeve, the core chucks and the screw sleeve dismounted from each other within the cartridge.

Industrial Applicability

According to the present invention, the cartridge in which the rod-like cosmetic material such as an eye liner, an eye brow pencil, a lip liner and an eye shadow is assembled into the sleeve body may be mounted detachably on the container body, and at the same time, the invention is available in the cartridge type feeding container for feeding the rod-like cosmetic material from the container body.

What is claimed is:

1. A cartridge type feeding container comprising: a cartridge having a through hole and in which core chucks provided with a rod-like core material are inserted slidably in an axial direction in said through hole; a container body engaged with said cartridge to be mountable and relatively rotatable through an internal member; and a mechanism for feeding said core chucks to a tip end side of said cartridge or retracting said core chucks to a rear end side thereof by the relative rotation, wherein:

said internal member is made of flexible material into a cylindrical shape and includes:

an outer circumferential surface fitting portion fitting with said container body is provided on a part of an outer circumferential surface of said internal member, an inner circumferential surface fitting portion fitting with said cartridge to be mountable and relatively rotatable is provided on a part of an inner circumferential surface thereof, a cutaway formed by combining a slit cut in a circumferential direction of the cylindrical internal member is formed between said outer circumferential surface fitting portion and said inner circumferential surface fitting portion;

said internal member and said container body form a container cover portion; and a shock to be applied from the outside of said container cover portion is buffered in the cutaway in said internal member and is prevented from being transmitted to said cartridge fitting with said inner circumferential surface fitting portion.

2. The cartridge type feeding container according to claim 1, wherein said internal member made of flexible material is made of synthetic resin.

3. A cartridge type feeding container comprising:

a cartridge having a through hole and in which core chucks provided with a rod-like core material are inserted slidably in an axial direction in said through hole;

a cylindrical container body engaged with said cartridge to be detachable and relatively rotatable through an internal member;

a longitudinal first rib provided in an axial direction on an inner circumferential surface of said container body and provided at a projecting end face with a slant surface;

a screw sleeve having a screw portion having a substantially cylindrical shape that may be received in said container body and engaging with said core chucks in the substantially cylindrical inner circumferential surface, said screw sleeve engaging with said cartridge to be rotatable relative thereto;

a second longitudinal rib projecting in an axial direction on a substantially cylindrical outer circumferential surface of said screw sleeve and engaging with said first longitudinal rib to be movable in the axial direction; and an internal member made of flexible material into a cylindrical shape and in which an outer circumferential surface fitting portion fitting with said container body is provided on a part of the sleeve outer circumferential surface, an inner circumferential surface fitting portion fitting with said cartridge to be mountable and relatively rotatable is provided on a part of the sleeve inner circumferential surface, and a cutaway formed by combining a slit cut in a circumferential direction is formed between said outer circumferential surface fitting portion and said inner circumferential surface fitting portion;

wherein:

said first longitudinal rib and said second longitudinal rib engage with each other upon the relative rotation so that said container body and said screw sleeve are rotated together to feed said core chucks which threadedly engage said screw sleeve, to a tip end side of said cartridge or to retract said core chucks to a rear end side; and an engagement portion for engaging said core chucks is provided in a through hole of said cartridge, when said core chucks are fed and brought into contact with said engagement portion of said cartridge and said core chucks are further fed, said cartridge depresses the inner circumferential fitting portion of said internal member toward said tip end side to compress said cutaway so that said screw sleeve kept in threaded engagement with said core chucks is moved toward the tip end side corresponding to the compression of said cutaway, whereby the engagement condition between said first longitudinal rib and said second longitudinal rib is released in a slant surface position of said first longitudinal rib.

4. The cartridge type feeding container according to claim 3, wherein the slant surface is provided at a projecting end face of said second longitudinal rib.

5. The cartridge type feeding container according to claim 3 or 4, wherein said internal member made of flexible material is made of synthetic resin.

* * * * *